United States Patent [19]

Caloni et al.

[11] 4,151,054

[45] Apr. 24, 1979

[54] PROCESS FOR OBTAINING SURFACES WITH A NACRE LIKE EFFECT ON GOLD OR SILVER JEWELRY ARTICLES

[76] Inventors: Olivio Caloni, via Curtatone, 2; Alfredo Cantini, Piazza Giotto, 20, both of Arezzo, Italy, 52100

[21] Appl. No.: 831,922

[22] Filed: Sep. 9, 1977

[51] Int. Cl.[2] ..... C25F 3/16

[52] U.S. Cl. ..... 204/129.35; 204/129.95; 204/129.65

[58] Field of Search ..... 204/129.1, 129.35, 129.95, 204/129.65

[56] References Cited

U.S. PATENT DOCUMENTS 2,416,294 2/1947 Eaton ..... 204/129.1 X

FOREIGN PATENT DOCUMENTS 1400747 7/1975 United Kingdom ..... 204/129.1

*Primary Examiner*—John H. Mack
*Assistant Examiner*—D. R. Valentine
*Attorney, Agent, or Firm*—Holman & Stern

[57] ABSTRACT

A process for obtaining a nacre effect on surfaces of gold, silver or alloys thereof, consisting in:

heating the metal having the highest purity degree up to a temperature higher than its melting point;

pouring of the molten material into a mold at a temperature compatible with the resistance of the mold;

allowing the material to cool into the mold;

performing a surface treatment on the article surfaces or portions thereof, where the nacre effect has to appear;

dipping the obtained article into an electrolytic bath including organic and/or inorganic salts, using a very low current density; and carefully washing the obtained article.

4 Claims, No Drawings

PROCESS FOR OBTAINING SURFACES WITH A NACRE LIKE EFFECT ON GOLD OR SILVER JEWELRY ARTICLES

The present invention relates to a physico-chemical process for producing a particular nacre effect on surfaces, or portions thereof, of articles made of gold or silver or alloys thereof, having at least a planar or smooth surface, said process being based on the informing principle of producing a very coarse crystalline grain in the employed material, by selecting the appropriate parameters which determine the formation of the desired crystalline grain, i.e. by starting out from a material of a high purity and heating said material up to a high temperature, then pouring the molten material into a molds and allowing it to cool very gradually, then performing a smoothing or other similar operation on the surface or surfaces, on which the crystalline grain will have to appear, and successively enhancing said crystalline grain or structure by means of an electrochemical treatment so as to attain a particular and unexpected aesthetical effect, which is used for decorative purposes.

The process comprises the following operative steps:

heating the metal or its alloys in a crucible or the like up to a temperature higher than its melting temperature, starting with a metal, or alloys thereof, of high purity, since the impurities negatively affect the process and tend to decrease the crystalline grain size, where said temperature has to be chosen to be about the highest temperature admitted by the resistance of the material of the crucible and by the integrity of the treated material; in general, temperatures of about 300° C. above the melting point of the material can be attained;

pouring the metal into a molding box or die, made of sand or other suitable material, into which said metal has allowed to cool slowly down to the ambient temperature, alternatively providing means, located near said molding box, and adapted to reduce the uniform heat transmission so as to obtain a cooling process which is slower than the natural one, if one desires to furtherly enhance the formation of a crystalline structure of coarser grain;

performing a step of diamond sand blasting, lapping or polishing so as to obtain a spiegel surface in those areas on which the desired decorative effect has to appear;

dipping the so obtained article into an electrolytic bath containing organic and/or inorganic salts of the type which are conventionally used in polishing processes, but carrying out said step with a low current density so as to enhance the formation of a coarse crystalline structure in the employed metal or alloys thereof; and performing a washing step.

After the cooling and polsihing steps the process further provides, as an alternative, other differentiated treatments of some portions of the surface or surfaces, such as plating, enameling or other known treatments which take place according predetermined shapes and patterns, with a subsequent screening of said so treated areas prior to the treatment of the remianing portions of the surface or surfaces of the article inside the electrolytic bath; therefore the decorative effects which are so created on the jewelry articles are due to both areas treated with conventional decorative processes and means, and areas obtained according to the process of this invention, i.e. which show a decorative effect due to an enhaced crystalline grain size which impart to the said surface portions a nacre-like effect.

According to a further variant, provision is made to perform a rolling process on the material, beyond the yield point of this latter, so as to modify the grain shape and to furtherly vary the obtained effects, before dipping the article into the electrolytic bath.

To test the crystalline structure of metals a process is already known which includes a surface polishing operation so as to be able to better inspect the crystalline grain, obtained by simply dipping the metal to be examined into a bath consisting of a solution of organic and/or inorganic salts of the class of the cyanides for the purposes of detecting eventual structural defects.

The present invention takes advantage of this informing principle, modifying and improving the same for different purposes. Therefore the invention provides not only to enhance the crystalline structure for obtaining aesthetical purposes, but also it provides to perform a prior process capable of increasing the grain sizes of the crystalline structure in order to attain a more effective and noticeable visual effect.

A merely illustrative example of the process of the present invention will now be given.

First of all it is to be pointed out that for the intended purposes it is necessary to use, as starting material, gold or its conventional alloys with silver and copper, which must be as pure as possible, since it has been proven that the impurities negatively affect the crystalline grain size.

Said material is to be put into a crucible and heated up to attain the highest possible temperature above the melting point of said material, while maintaining the crucible integrity as well as not altering the material to be treated. In general, it is proven than the material can be heated 300° C. above its melting point. such heating step is very important, since it is proved that the crystalline grain size depends on the starting temperature and on the heat stored inside the material when the slow cooling begins. The material is then poured into a mold of sand or other suitable material, which is maintained at a temperature of about 800° C. and in which the material is allowed to cool naturally by a uniform heat transmission process and carefully avoiding any increase of the cooling speed. On the contrary, for particular purposes, or in particular operative or climatic conditions, the mold could be placed in a controlled ambient so that the cooling process will be not only uniform but also it will take place more slowly than under natural conditions, since, as has been mentioned hereabove, the grains of the crystalline structure will have as larger sizes as the mass cooling is slower. When the cooling step of said so shaped article is completed, this latter is subjected to a diamond sand blasting treatment, or to a lapping, polishing or the like, according to the conventional techniques, said operations being applied at least on those surfaces on which the desired decorative nacre-like effect has to appear.

Then, on particular areas of said surface or surfaces, on which one desires to obtain particular different effects according to predetermined pattern, an electroplating, or the application of enamels or the like is performed. In the case in which such a variant is performed, said so treated areas will be subsequently screened by the application of a protective coating of any suitable type which can be easily physically or chemically removed, when the process has been completed. Therefore after such an operation of surface preparation and the optional particular surface treatment and screening of some areas of the article, this latter is dipped into an electrolytic bath containing organic and/or inorganic salts of those types which are used normally for performing an electrolytic polishing. It is to be pointed out that, even if the bath is substantially conventional, the electrolytic treatment of this invention is different, since in a conventional electrolytic polishing process high current densities are used, while, on the contrary, according to the present invention, it is necessary to operate with very low current densities and precisely with a current density which varies from values slightly higher than zero to values not higher than about 0.25 A/cm2.

It is to be noted that in laboratory tests on the crystalline structure of metals, which are performed for the purposes of controlling, whether there are or not defects in the crystalline structure, the material is simply dipped into the treatment bath, without using any electrolytic bath. A particularly appropriate bath, according to the present invention, can consist of an aqueous solution containing about 10% of potassium cyanide and about 10% of ammonium ipersulphate, even if other suitable solutions comprising cyanide salts or the like could be used. In particular a preferred bath contains 30 g/l of potassium cyanide and 10 g/l potassium ferrocyanide.

According to the present invention and for the aforementioned purposes provision is made not only to obtain the more coarse possible grain, but also to enhance said crystallyne structure owing to the action of the electrolytic bath. From that it results, that it is necessary to use an electrolytic bath, instead of a simple attack bath for the articles made of gold, silver and alloys thereof.

After this treatment and the removal of the screening coating, if a plating or similar treatment is provided on particular areas of the article, this latter is subjected to a washing operation as well as, if one desires so, to other known finishing treatments.

As a variant, the material could be subjected to a rolling step prior to its dipping into the bath, on the purpose of modifying also the grain shape of the material and so as to obtain further aesthetic different effects.

What we claim is:

1. A process for obtaining a nacre-like effect on surfaces of articles made of gold, silver or alloys thereof comprising the steps of:

(a) selecting a material from the group consisting of gold, silver, and jewelry alloys thereof having a high purity, (b) heating said material in a crucible to obtain the highest possible temperature above the melting temperature of said material, while maintaining the crucible integrity as well as not altering the material to be treated;

(c) molding said material in a mold at a temperature compatible with the resistance of said mold to form an article;

(d) allowing said article to cool to ambient temperature inside of said mold;

(e) surface treating said article at least on those surfaces on which the effect is to appear by a mechanical polishing;

(f) electrochemically treating said article by placing the same in an electrolytic bath as an anode using very low current densities, said bath containing conventional electrochemical polishing salts having a cyanide content; and (g) carefully washing said treated article.

2. The process according to claim 1, wherein said electrolytic bath consists of an aqueous solution containing about 30 g/l of potassium cyanide and about 10 g/l of potassium ferrocyanide, and said current density is within a range from a value near zero to a value not higher than about 0.25 A/cm2.

3. The process according to claim 1, further comprising between steps e and f, the steps of:

surface decorating said article on a portion thereof where the effect is not desired, and applying a protective coating to said decorated portions; and following step g, removing said protective coating.

4. The process according to claim 1, further comprising prior to step f, the step of rolling said article in order to modify the grain shape of the metal crystalline structure.

* * * * *